United States Patent [19]

Schoofs

[11] Patent Number: 4,832,643

[45] Date of Patent: May 23, 1989

[54] HAND PADDLE FOR USE BY SWIMMERS

[76] Inventor: Mark J. Schoofs, Box 566 Yale Station, New Haven, Conn. 06520

[21] Appl. No.: 652,110

[22] Filed: Sep. 19, 1984

[51] Int. Cl.[4] ..... A63B 31/10

[52] U.S. Cl. ..... 441/56

[58] Field of Search ..... 441/55, 56, 58, 57

[56] References Cited

U.S. PATENT DOCUMENTS

| | | | |
|---|---|---|---|
| 2,006,915 | 7/1935 | Ferber | 441/56 |
| 2,556,894 | 6/1951 | Axiotes | 441/56 |
| 3,117,325 | 1/1964 | Shelton | 441/56 |
| 3,182,657 | 5/1965 | Zurbuchen | 441/56 |

*Primary Examiner*—Sherman D. Basinger
*Assistant Examiner*—Stephen P. Avila
*Attorney, Agent, or Firm*—Limbach, Limbach & Sutton

[57] ABSTRACT

A hand paddle for use in swimming is disclosed which comprises a glove-like body having an interior recess for receiving a human hand, said body having a relatively flat bottom surface and a convex upper surface, the upper surface being cambered longitudinally and laterally so that the highest point of the upper surface is centrally located in that surface.

2 Claims, 1 Drawing Sheet

HAND PADDLE FOR USE BY SWIMMERS

TECHNICAL FIELD

A variety of swimming aids have been proposed for use and used by swimmers to increase swimming speed or as training aids to develop stroke technique and stroke power. A variety of foot fins are commercially available for use by swimmers and to a lesser extent swimming aids in the form of hand paddles or arm attachments have been available.

The general concept underlying the design of swimming aids heretofore in use has been that swimming progress was made by pushing water backward along the line pursued by the swimmer, and that if a larger surface were available for use in such a backward push a more effective and stronger push would be obtained.

The hand paddle of the present invention is not based on this concept but rather on the concept that if the paddle is used in reasonably proper execution of any of the four swimming styles used in competitive swimming then the Bernoulli effect on the hand paddle provides the increased speed and will make inefficiencies in the swimmer's stroke more readily detectable.

SUMMARY OF THE INVENTION

The hand paddle of the present invention is a glove-like body having an interior recess for receiving a human hand. The hand paddle has a relatively flat bottom surface and a convex upper surface. The upper surface of the hand paddle is cambered longitudinally, rising from the fingertips to a point roughly above the knuckle of the middle finger of the hand and then curving downward to the wrist. The paddle is also cambered laterally, curving upward from the thumb side of the hand until a point about at the middle finger portion of the hand is reached and then curving downward toward the little finger side of the paddle.

The double camber of the hand paddle has the effect of placing the highest point of the upper surface of the paddle in the middle area of the upper surface and generally in a point more or less above the knuckle of the middle finger of the hand. The double camber of the paddle also gives it a general appearance which is rather similar to that of a tortoise shell.

BRIEF DESCRIPTION OF THE DRAWINGS

In the appended drawings

DETAILED DESCRIPTION OF THE INVENTION

Figure 1:
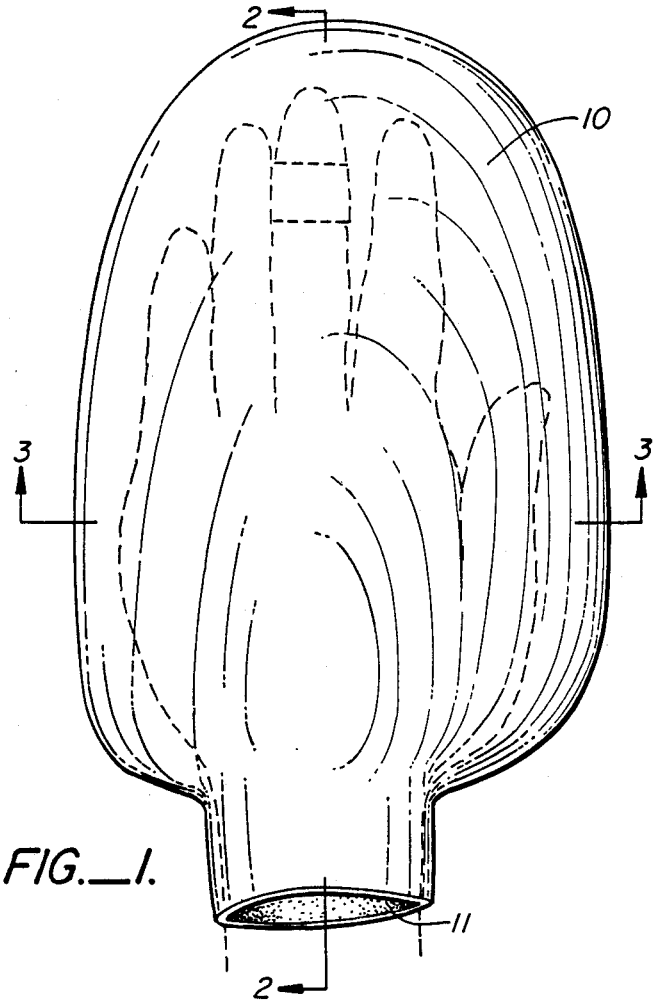
FIG. 1 is a plan view of the upper surface of the hand paddle with the human hand shown in phantom.

Referring now to FIG. 1 of the drawings, the upper surface 10 of the hand paddle is shown and the shape of the contained hand is shown in phantom in the drawing. The hand paddle conforms generally to the shape of the human hand but is both longer and wider than the hand intended to be contained. Generally, the fingertip end of the hand paddle will extend beyond the fingertips of the contained hand by one to two inches, and the sides of the hand paddle will extend beyond both the thumb and little finger sides of the contained hand by about an inch to an inch and a half. The paddle contains an opening 11 at the wrist end of the paddle to permit passage of the hand into the interior of the paddle.

The interior of tee hand paddle may be shaped to provide a reasonably close fit to the hand inserted in the paddle and this shaping may be done using the bottom surface of the paddle or using the top surface of the paddle to provide the fitting form or by using both for that purpose.

Figure 2:
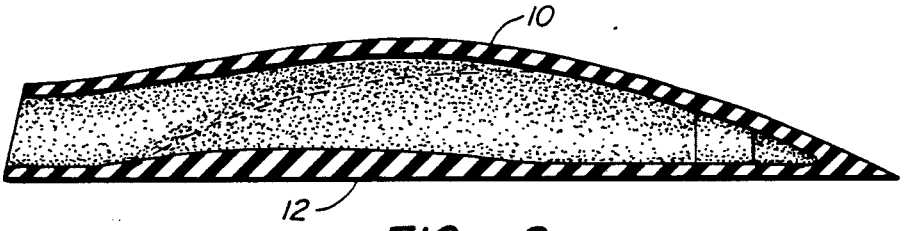
FIG. 2 is a cross section of the hand paddle taken along the line 2—2 of FIG. 1.

FIG. 2 of the drawings shows the longitudinal cross section of the hand paddle and shows the cambered upper surface rising from fingertips to midpoint and curving downward toward the wrist end. The bottom surface 12 of the hand paddle is relatively flat and may be a completely closed surface so that no water can directly come into contact with the contained hand or it may be a relatively open surface formed of one or more transverse cross pieces on which the contained hand will rest. When a single transverse crosspiece is employed it will lie between the fingertip end and the wrist end of the paddle and will be of such width that it does not fully close the interior of the paddle. When two or more transverse crosspieces are employed they are noncontiguous and do not fully close the interior of the paddle. In both cases water can pass into the interior of the paddle and into contact with the hand.

Figure 3:
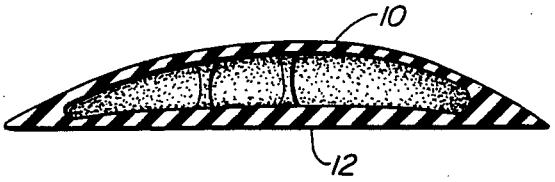
FIG. 3 of the drawing is a cross section of the hand paddle taken along the line 3—3 of FIG. 1.

FIG. 3 is lateral cross section of the hand paddle and shows the cambered upper surface 10 which curves from the thumb side upward and then curves downward toward the little finger side of the paddle cross section.

BEST MODE FOR CARRYING OUT THE INVENTION

The hand paddles of the present invention may be constructed from plastic materials or hardened rubber. They should be of sufficient firmness that they retain their shape against the forces which may be applied to the paddle during the course of its use, but should preferably not be of brittle hardness but rather of resilient character.

The hand paddle of the invention is useful in swimming or training for swimming any of the four competitive strokes now in use, i.e., the butterfly, backstroke, breaststroke and freestyle, often called the crawl. The basic elements of the hand movements in each of these competitive strokes are the same, the movements being a downsweep, an insweep, and an outsweep and upsweep. During these sweeping movements the upper surface of the hand paddle faces either the direction or at an angle to the direction in which the swimmer is moving. To put the matter another way, an observer toward whom the swimmer is moving, who watches the hand movements will see always the upper surface of the hand paddle either in full or at an angle and will not see its lower surface at all during the sweeping movements. As the hand paddle moves through the water, the rate of movement of the water relative to the hand paddle is greater at the upper cambered surface than it is at the lower relatively flat surface. This higher relative velocity produces the Bernoulli effect and produces a lifting force in the direction in which the back of the hand paddle is pointed. This lifting effect in the four competitive strokes when properly executed increases the forward speed of the swimmer. The sweeping movements of the hands in properly executing the crawl-stroke are well described in *Swimming Faster,* Maglisco, Mayfield Publishing Co., Palo Alto, Calif., 1982, at pages 56—58, and the description conforms with the summary description above.

I claim:

1. A hand paddle for use in swimming comprising a body conforming generally to the shape of the human hand and having an interior recess for receiving a human hand, said body having a relatively flat bottom surface and a convex upper surface, the upper surface being cambered longitudinally from fingertip end to wrist end so that the longitudinal thickness of the body is greatest in the area intermediate the fingertip end and wrist end of the body and cambered laterally from the thumb side of the hand to the little finger side of the hand so that the lateral thickness of the body is greatest in the area between the sides of the hand, and the body being formed by a material having sufficient firmness to retain its shape against the forces applied to it during the course of use in swimming.

2. A hand paddle for use in swimming comprising a generally hand-shaped body having an interior recess for receiving a human hand, said body having a relatively flat bottom surface and a convex upper surface, the upper surface being cambered longitudinally from fingertip end to wrist end and laterally from the thumb side of the hand to the little finger side of the hand so that the highest point on the upper surface lies at a point approximately midway between the sides of the interior recess and approximately midway between the fingertip end and the wrist end of the body.

* * * * *